US009289793B1

(12) United States Patent
Bonner et al.

(10) Patent No.: US 9,289,793 B1
(45) Date of Patent: Mar. 22, 2016

(54) PROFILE CORRECTION MODULE

(71) Applicants: Michael R. Bonner, Romeo, MI (US); James A. Kirchoff, Romeo, MI (US)

(72) Inventors: Michael R. Bonner, Romeo, MI (US); James A. Kirchoff, Romeo, MI (US)

( * ) Notice: Subject to any disclaimer, the term of this patent is extended or adjusted under 35 U.S.C. 154(b) by 183 days.

(21) Appl. No.: 13/922,112

(22) Filed: Jun. 19, 2013

Related U.S. Application Data

(60) Provisional application No. 61/661,488, filed on Jun. 19, 2012.

(51) Int. Cl.
*B05C 1/08* (2006.01)
*B41F 31/02* (2006.01)

(52) U.S. Cl.
CPC ..... *B05C 1/0813* (2013.01); *B05C 1/0834* (2013.01); *B05C 1/0865* (2013.01); *B41F 31/02* (2013.01)

(58) Field of Classification Search
CPC .... B05C 1/003; B05C 1/0813; B05C 1/0834; B05C 1/0865; B41F 31/02–31/14
See application file for complete search history.

(56) References Cited

U.S. PATENT DOCUMENTS 5,497,702 A * 3/1996 Gorter ..... B41F 31/027 101/366
2006/0219165 A1* 10/2006 Cerciello ..... 118/244

* cited by examiner

*Primary Examiner* — Dah-Wei D Yuan
*Assistant Examiner* — Stephen Kitt
(74) *Attorney, Agent, or Firm* — Young Basile; Denise Glassmeyer

(57) ABSTRACT

A profile correction module is comprised of a reinforced convex steel form accurately and firmly held in position to create a metering gap along the face of the pickup roller to control the liquid coating material that is applied to the pickup roller and subsequently transferred to the nip between the pickup and applicator rollers prior to being applied to the substrate or "strip". By flushing stale material from the metering gap with fresh coating material, edge-to-edge temperature variations are eliminated resulting in a uniform film thickness across the width of the strip.

11 Claims, 7 Drawing Sheets

PROFILE CORRECTION MODULE

CROSS-REFERENCE TO RELATED APPLICATIONS

This application claims priority to U.S. Provisional Patent Application No. 61/661,488 filed Jun. 19, 2012, which is hereby incorporated by reference in its entirety.

TECHNICAL FIELD

The present invention relates in general to coil coating.

BACKGROUND

In the field of coil coating, a liquid coating is applied via a roller to a continuous strip of material being moved through the coating system, the process and equipment for which is well established. The strip that forms the substrate for the coating is usually steel or aluminum, but may also be of a fabric, plastic, composite or other material. In each case the performance of the final product is dependent on the coating being of a consistent thickness along both the length and the width of the coated strip. Variations in coating thickness can result in variations in color, gloss and surface finish; reductions in anti-corrosion properties and durability; and can even create difficulties in post-processing operations.

Virtually all coating materials change viscosity as a function of temperature. This relationship is both non-linear and inversely proportional. Furthermore, the specific nature of this relationship is unique to each coating formulation. It has been found that variations in temperature exist along the surface of the roller. This can adversely impact coating application and the quality of the resulting applied material. Thus it would be desirable to provide a method and device that regulates the temperature and/or viscosity of the material across the roller and associated continuous strip.

This is clearly demonstrated in FIG. 1 which shows the Viscosity vs. Temperature for a selection of colors of paint all created from the same resin base by the same manufacturer. The variation in each curve is a function of the changes in pigment, fillers, stabilizers, etc. required to get the desired performance from that coating.

Thus, it would be desirable to provide a method and device which addresses such variations and reduces or eliminates the associated problems.

SUMMARY

Disclosed herein is a device that includes a reinforced convex steel form, a pickup roller, an applicator roller, at least one nip located between the pickup roller and at least one applicator roller. The device also includes means for holding the convex steel form in position to create a metering gap between the reinforced convex steel form and the pickup roller positioned to control the liquid coating material applied to the pickup roller and subsequently transferred nip between the pickup and the at least one applicator roller prior to being applied to an associated substrate. The device accomplishes flushing of the metering gap with temperature-controlled coating material, edge-to-edge temperature variations can be reduced or eliminated.

BRIEF DESCRIPTION OF THE DRAWING

In order to further illustrate and describe the invention disclosed, attention is directed to the various drawing figures in which like reference numerals are employed for like elements throughout the various views and figures.

DETAILED DESCRIPTION

In the field of coil coating, application of a liquid coating via a roller to a continuous strip of material as the continuous strip of material moves through the coating system has been employed. The continuous strip that forms the substrate for the coating is usually steel or aluminum, but may also be of a fabric, plastic, composite or other suitable material. In each case, the performance of the final product is dependent on the coating being of a consistent thickness along both the length and the width of the coated strip. Variations in coating thickness can result in a variety of undesirable outcomes. These include, but are not limited to, variations in color, gloss and surface finish; reductions in anti-corrosion properties and durability. In certain situations coating thickness variations can even create difficulties in post-processing operations.

Figure 1:
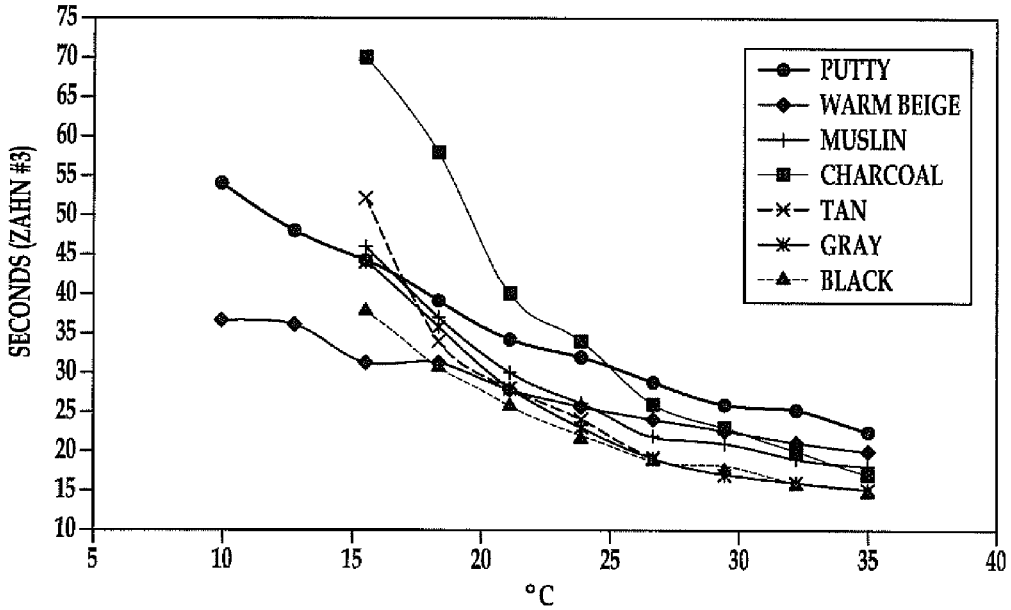
FIG. 1 is a Viscosity vs. Temperature Chart for various colors of a typical paint.

It has been well documented that virtually all coating materials change viscosity as a function of temperature and that this relationship is both non-linear and inversely proportional. Furthermore, the specific nature of this relationship is unique to each coating formulation. This is clearly demonstrated in FIG. 1 which shows the Viscosity vs. Temperature for a selection of colors of paint all created from the same resin base by the same manufacturer. The variation in each curve is a function of the changes in pigment, fillers, stabilizers, etc. required to get the desired performance from that coating.

Figure 2:
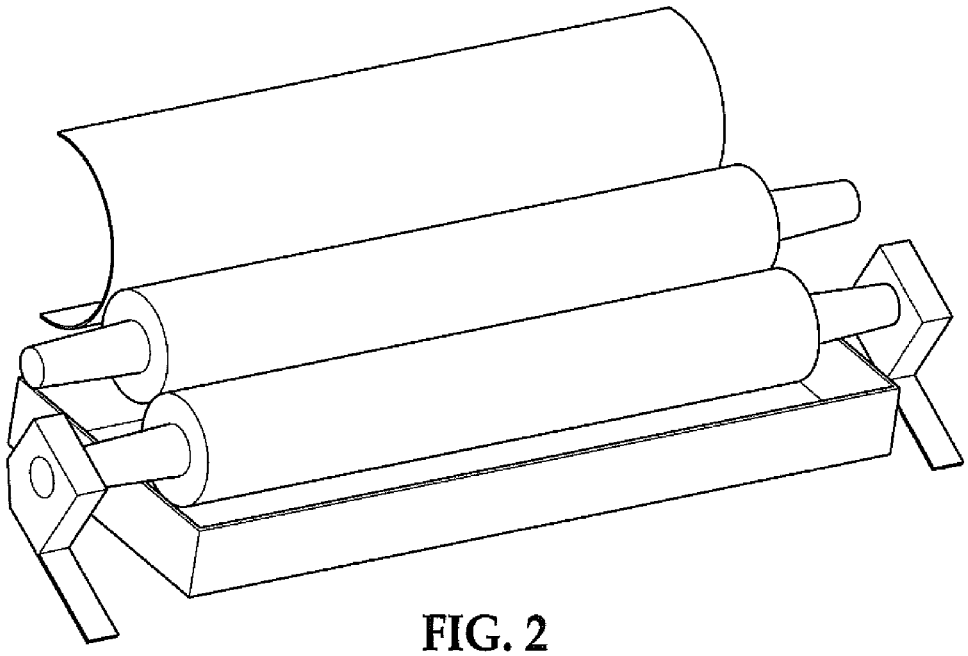
FIG. 2 is an orthogonal view of an embodiment of a standard two-roller coil coating configuration for illustration purposes.
Figure 3:
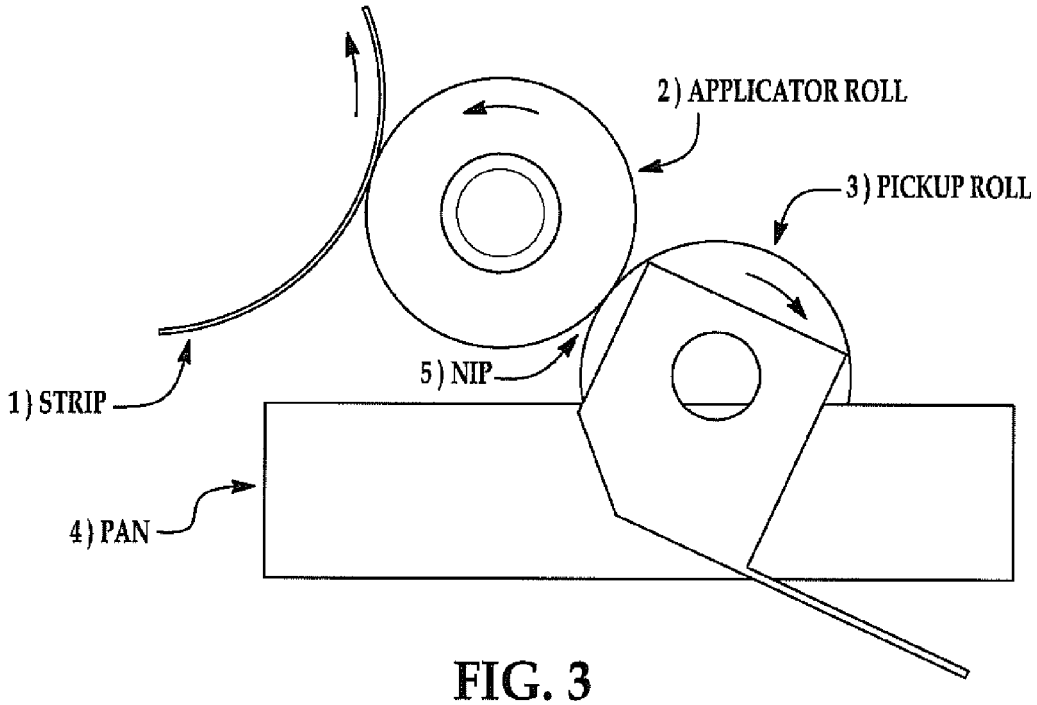
FIG. 3 is an end view of an embodiment of standard two-roller coil coating configuration of FIG. 2.

FIG. 2 shows a typical two-roller coating system used to apply the coating to the strip. In such as system, the strip (1) presented to the coating head where the coating is picked up from the pan (4) by the pickup roll (3) and is then transferred to the applicator roll (2) which applies it to the passing strip (1). The direction of travel of the strip and rollers for a two-roll reverse coating operation is shown in FIG. 3. The coating in the pan (4) is picked up by the pickup roll (3) and delivered to the nip (5) which is defined as the point where the pickup roll (3) and applicator roll (2) are pressed together. The pickup roll (3) has a hard surface and is usually constructed of steel and is sometimes coated with a suitable coating such as ceramic. The applicator roll (2) has a compressible surface and is usually constructed of steel with a thick coating of urethane or other suitable polymer coating. These two rolls are forced together under pressure, often in the range of 2,000-3,000 PSI. When the paint enters the nip (5), it is squeezed down so a thin film remains on the applicator roll (2) to be applied to the strip (1). The thickness of the film is determined by factors such as the pressure between the rolls at the nip (5), the durometer of the compressible coating on the applicator roll (2) and the viscosity of the coating material. The balance of the coating on the pickup roll (3) is sheared away by the action of the nip (5) and falls back into the pan (4).

Because of the texture of the surfaces of the applicator roll (2) and the pickup roll (3), and the pressure between them, a great deal of friction results which generates heat. Additionally, the friction between the applicator roll (2) and the strip (1) as the coating material is applied also generates heat. Some of the heat generated by this process is carried back to the pan by the coating material squeezed out of the nip (5) that mixes with the coating material in the pan below. Additional heat is introduced by the pickup roll (3) which is submersed and rotates in the coating material in the pan (4).

The flow of coating material in the pan (4) is determined by numerous factors including the geometry of the pan (4) itself, the rate at which the coating material is being pumped into the pan (4), the location of the inlet of the pan, the location of the outlet of the pan, the speed of the pickup roll (3) and the rate of coating usage. Because of all the rotational vectors generated by the various motions in the system, significant swirls and eddy currents are generated in the coating material in the pan (4). As such, the heat generated by the friction forces in the system is unevenly distributed throughout the coating material in the pan (4). Specialized systems for measuring these temperature variations and these measurements have repeatedly shown that significant temperature variations are presented to the nip (5) along the width of the strip (1).

Figure 4:
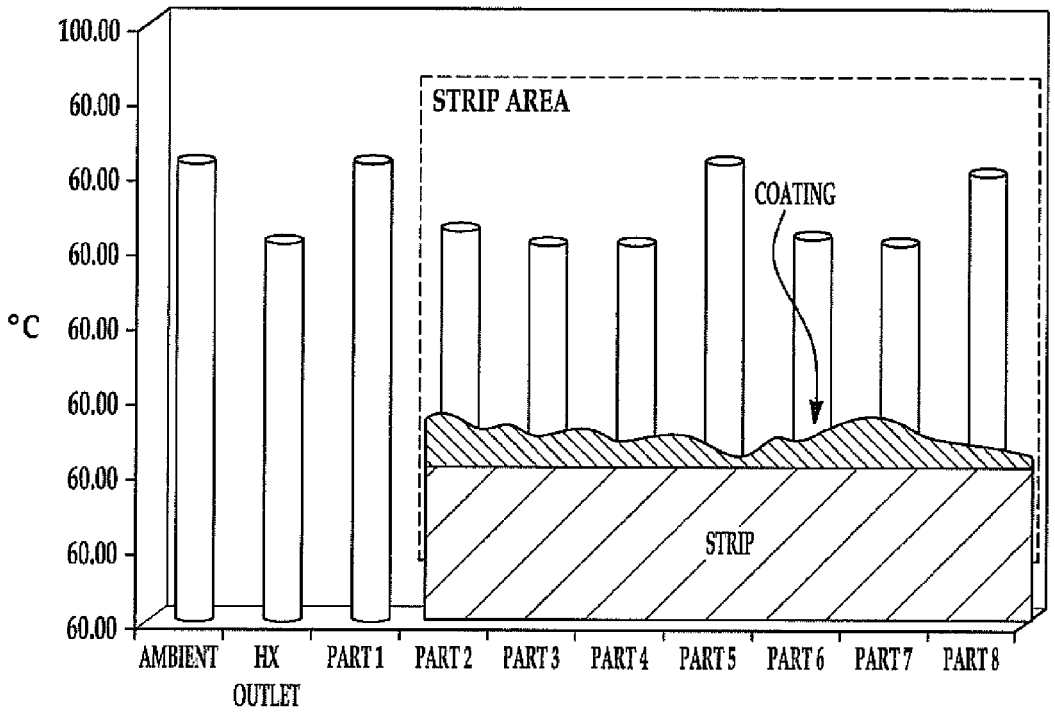
FIG. 4 is a diagram showing the typical variation in temperature measured across the width of a strip and the resulting variation in film build.

Because of the relationship between temperature and viscosity discussed above and demonstrated in FIG. 1, the warmer coating material presented to the nip (5) will be at a lower viscosity than the cooler coating material in the pan (4). As a result, the viscosity of the film of coating material allowed to pass through the nip (5) as a result of the process described above will be lower. Because of the compressible surface of the applicator roll (2), it is possible to have different displacements in adjacent areas across the width of the applicator roller (2) width, resulting in variation of the coating film across the width of the applicator roll (2) that is subsequently applied to the strip (1). A diagram demonstrating this variation in temperature across the width of the pickup roll (3), called the "Thermal Profile", and the resulting variation in film build up across the width of the strip (1) is provided in FIG. 4.

Figure 5:
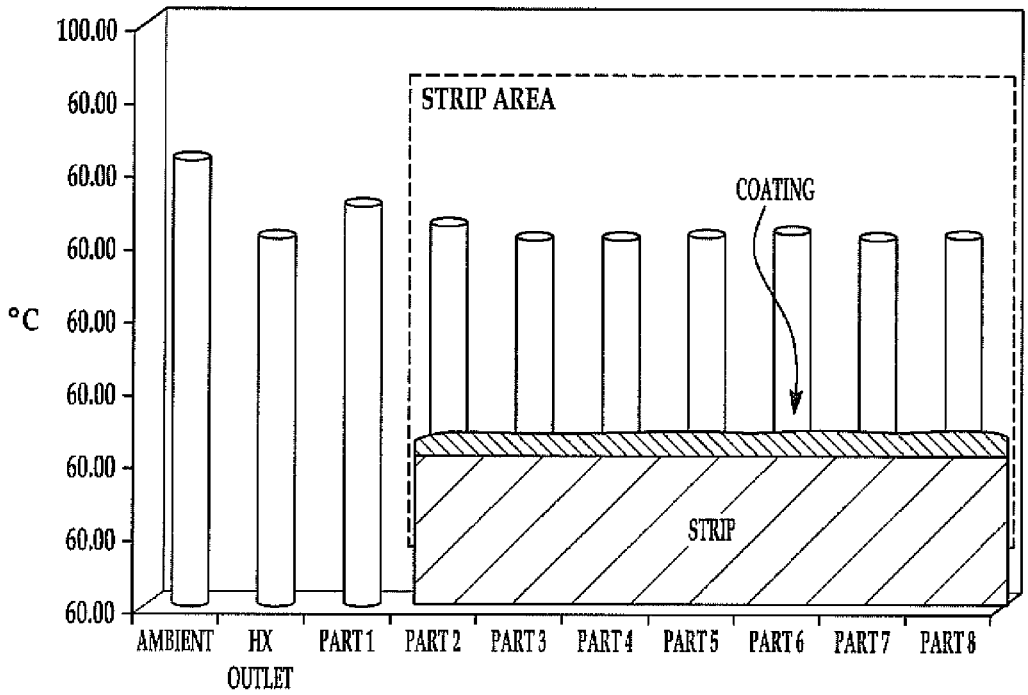
FIG. 5 is a diagram showing the corrected temperature profile measured across the width of a strip and the reduced variation in film build.
Figures 13A, 13B:
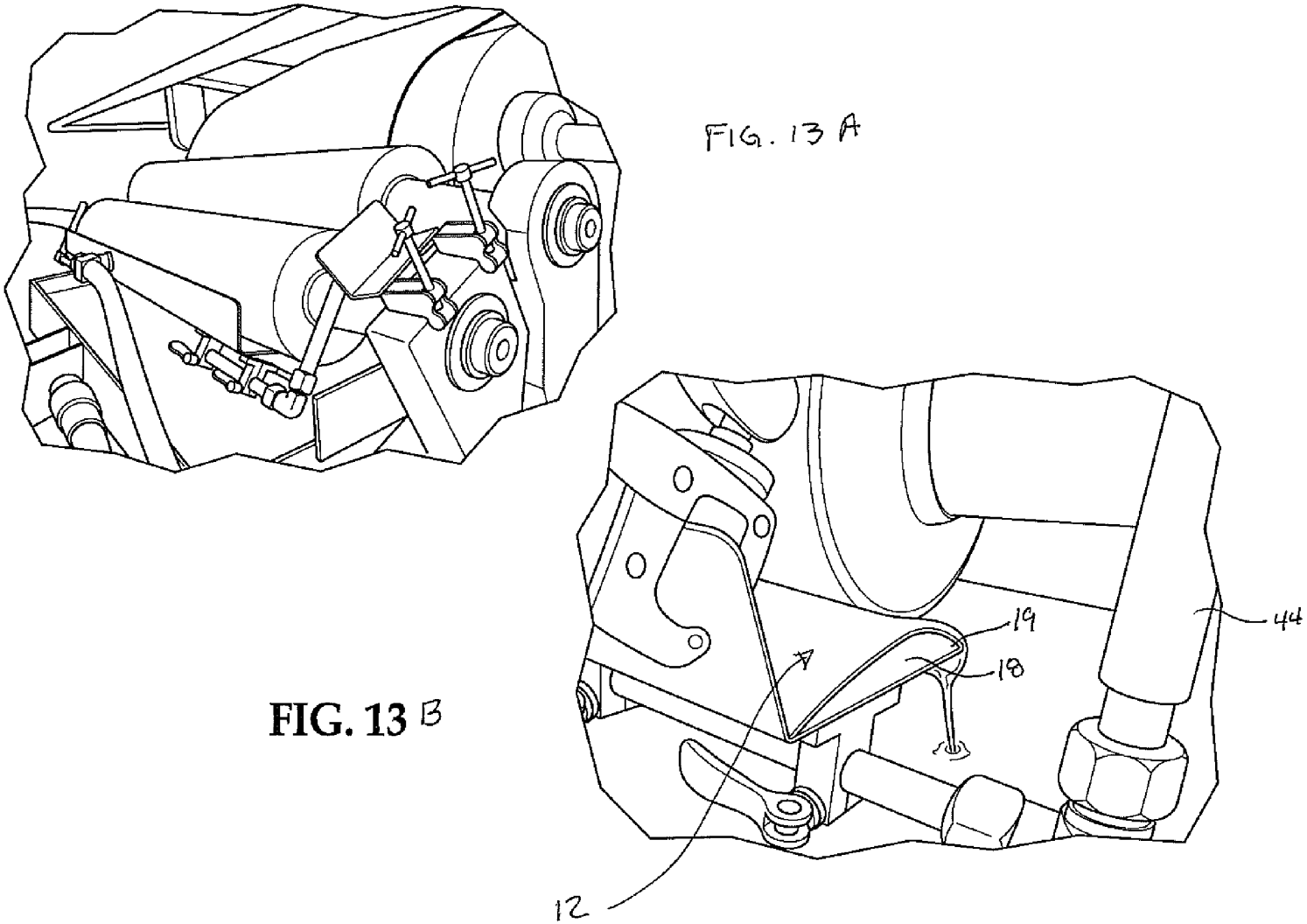
FIG. 13A is a partial perspective showing an embodiment of mounting bracket assembly in an embodiment of the system as disclosed herein.
FIG. 13B is a partial perspective showing an embodiment of exit region employed on the convex member in an embodiment of the system as disclosed herein.

The device disclosed herein is generally referred to as a profile correction module. The device disclosed herein can be used to reduce or eliminate the temperature variation across the width of a strip to be coated particularly during coating operations. If the temperature is consistent at all points on the strip from edge-to-edge, the viscosity of the coating material along this path will also be consistent and the resulting film transferred to the strip (1) will be even from edge-to-edge as shown in FIG. 5. In certain embodiments, the fluid coating material may be temperature-controlled. Without being bound to any theory, it is believed that the device disclosed herein achieves greater uniformity in viscosity and ultimately in coating by one or more of the following ways:

1. Coating material is metered to the surface of the pickup roll (3) through a carefully controlled gap created by the physical location of the profile correction module device 10 in relation to the pickup roll (3) face.
2. The gap is continuously flushed with fresh coating material from the center to the ends to drive out any coating material that has been in contact with the rolls long enough to absorb energy and increase temperature. An illustration of the flushing action and fluid exit is shown in FIG. 13A wherein fluid exits from the edge 18 at exit region 19.
3. The pan (4) is lowered such that the coating material in the pan (4) is no longer in contact with the pickup roll (3) and therefore temperature variations in the pan (4) created by swirls and eddy currents cannot be transferred to the applicator roll (2) by the pickup roll (3).

Though there have been several arrangements for the applicator roll (2) and pickup roll (3) observed on different machines across the industry, all are contemplated by this invention and will benefit similarly through its implementation.

Figure 6:
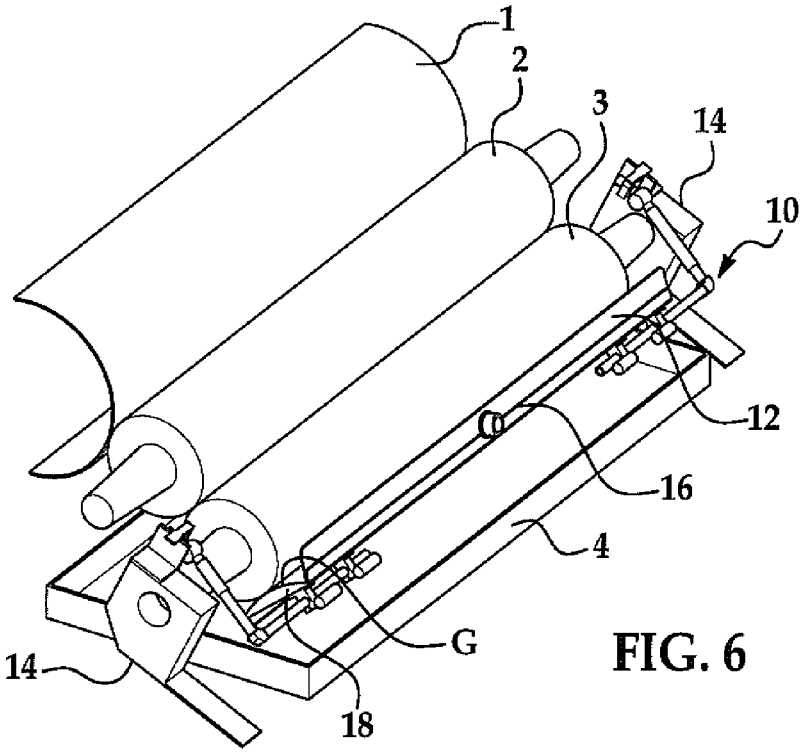
FIG. 6 is an orthogonal view of an embodiment of the profile correction module disclosed herein in place on a coating head.

Shown in position on a representative coil coating head in FIG. 6, the profile correction module device 10 as disclosed herein is comprised of a reinforced convex steel platen 12 accurately and firmly held in position by a rigid, adjustable mounting bracket system 14 to create a uniform, infinitely adjustable metering gap G along the face of the pickup roller 3 to control the liquid coating material that is applied to the pickup roller 3 and subsequently transferred to the nip 5 located between the pickup roller 3 and applicator roller 2 prior to being applied to the substrate or "strip" 1. By flushing this metering gap G with temperature-controlled coating material from the center 16 to the ends 18, 18', edge-to-edge temperature variations are reduced or eliminated resulting in a uniform film coating thickness across the width of the strip 1.

Figure 7:
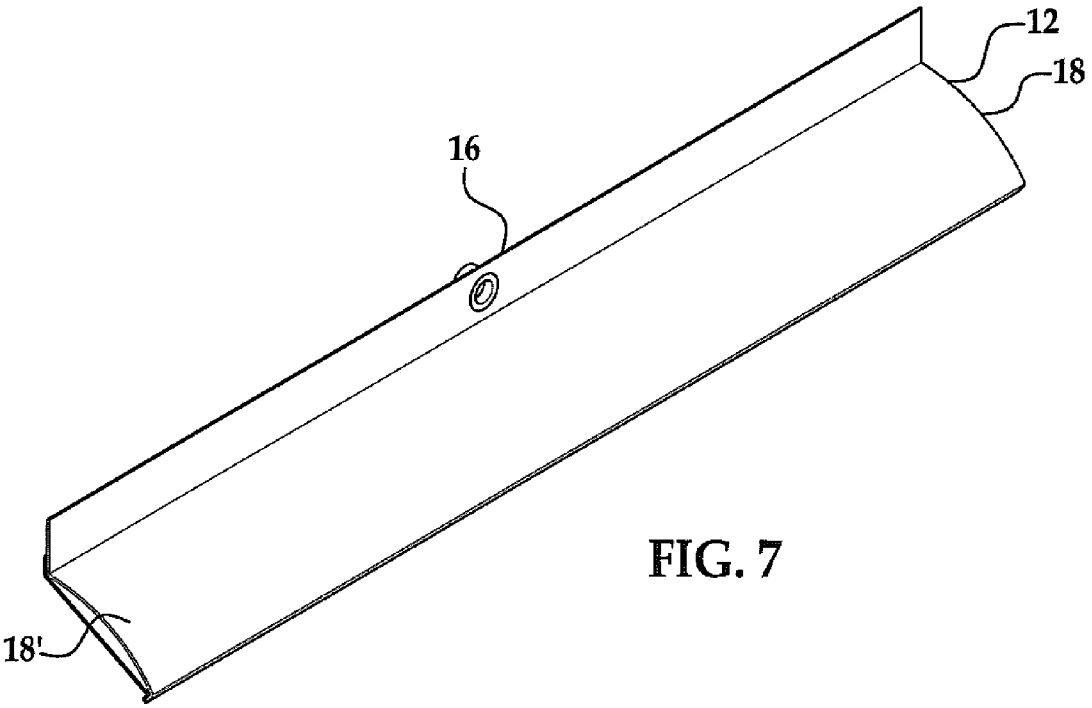
FIG. 7 is an orthogonal view of an embodiment of a platen assembly suitable for use with the device of FIG. 6.

The profile correction module platen assembly 12 shown in FIG. 7. The platen assembly 12 includes a convex surface 20 located on the upwardly oriented face of the platen 12. This creates a single line gap to the surface 22 of the pickup roller 3 at the tangent point T between the two respective curved surfaces. The platen 12 can be supported by a reinforcing gusset 24 configured to maintain the rigidity of the associated structure to assure that there is no flex that can vary the gap G between the surface of the platen 12 and the surface of the pickup roller 3 along their respective lengths. In at least one preferred embodiment, components such as the platen 12 and/or the reinforcing gusset 24 can be constructed from stainless steel sheet, due to its compatibility with most common coating materials. However, fabrication from any rigid material including metals such as titanium or aluminum, composites, or even polymeric materials is also anticipated.

Figure 8:
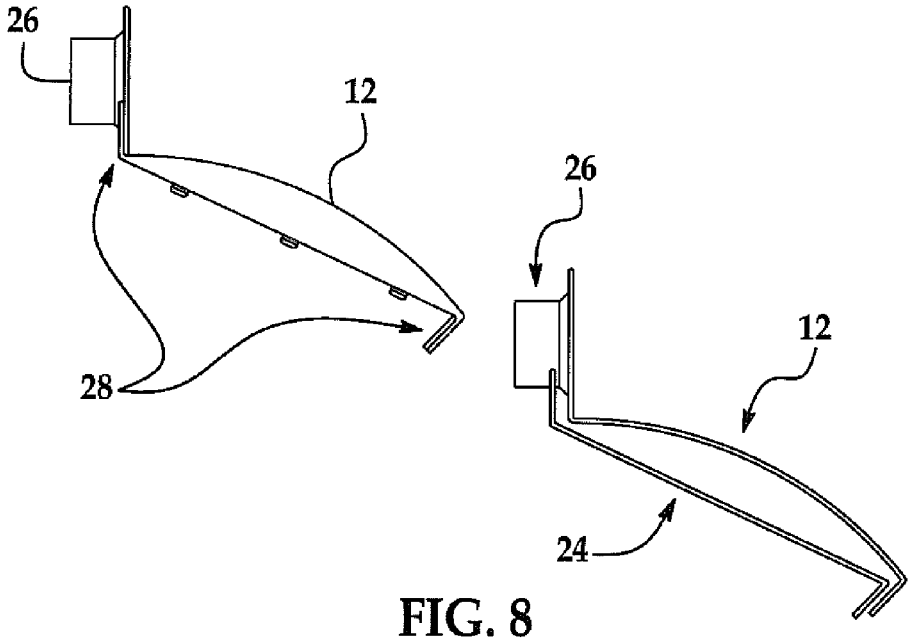
FIG. 8 is an end view of an embodiment of the profile correction module platen assembly in both assembled and exploded forms.

FIG. 8 shows the platen and supporting gusset assembly. This view shows the construction of the assembly comprised of the profile correction module platen 12 with a coating inlet 26 and the supporting gusset 24 fastened together at the joining surfaces 28. This assembly method assures that the contact surface of the profile correction module platen 12 remains smooth and continuous to provide a uniform metering gap with the Pickup Roll (3). In the preferred embodiment, the coating inlet 26 would be welded into place at the center point of the profile control module platen 12 and the profile control module platen 12 and supporting gusset 24 would be joined by spot welds along the joining surfaces 28 to provide the desired rigidity, though the joining by other bonding means such as stitch welds or adhesives is also anticipated. Coating inlet 26 can be configured to engage a suitable fluid conveying conduit that can bring suitably conditioned fluid from any suitable source into contact with the pickup roll 3. The fluid source can be pan 4 or can be other suitable reservoirs (not shown).

Figure 9:
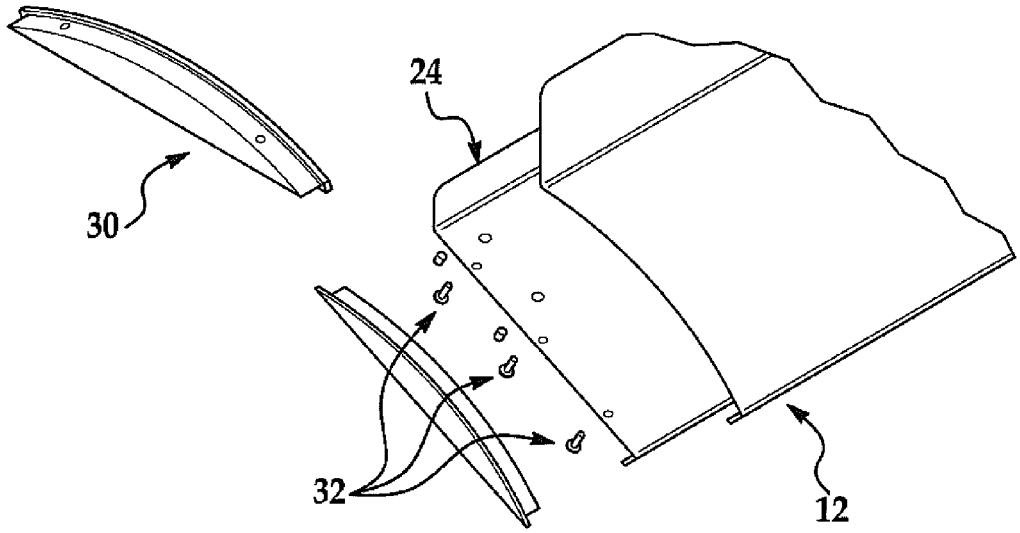
FIG. 9 is an orthogonal view of an embodiment of an end cap and its assembly into the profile correction module platen assembly of FIG. 8.

To prevent the space between the profile control module platen 12 and supporting gusset 24 from filling with coating material during the coating process, the respective ends 18, 18' are each plugged with an end cap 30 as shown in FIG. 9. In the preferred embodiment, this End Cap 30 is held in position with threaded fasteners 32 passed through the supporting gusset 24, though installation by press-fit or with adhesives is also anticipated. In addition, though shown as a flat end, this could also be configured with a rounded end or a "wing" to direct the coating into the collection pan.

The stainless steel construction of each of these components in the embodiment disclosed herein allows them to be finished by electropolishing to provide a highly smooth surface that will make it easy to remove coating material during the cleaning process, though other low friction release coatings such as Teflon are also anticipated, especially when other materials are used for the construction.

Figure 10:
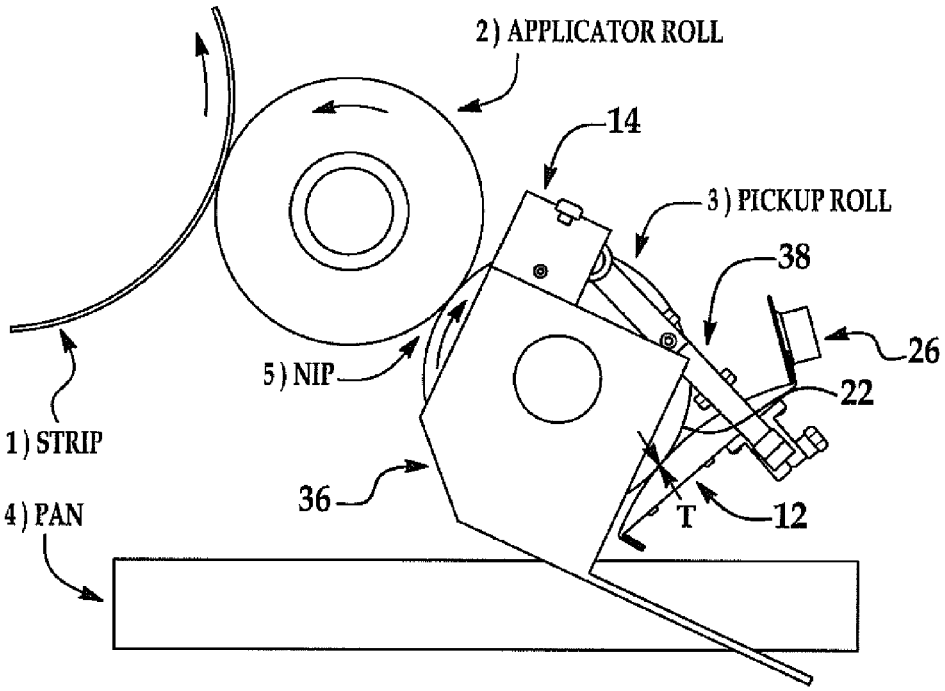
FIG. 10 is a left end view of an embodiment of a profile correction module assembly as disclosed herein in place on a coater head.

FIG. 10 depicts the details of an embodiment of the profile control module device 10 as disclosed herein in combination with mounting hardware that places the device 10 in the position to perform its function. In the embodiment depicted, a mounting bracket 34 is rigidly mounted to the pickup roll bearing saddle 36 to assure that the profile control module device 12 travels with the pickup roll (3) always maintaining a consistent and uniform metering gap independent of the position of the pickup roll (3) with respect to the applicator roll (2) or the strip (1). There are many different styles of bearing saddles 36 available, and the mounting bracket 34 may be configured with adjustable clamps for mounting or may be custom fabricated to allow it to mate with the specific bearing saddle 36 on a given coating head using the existing bolt pattern with the same or slightly longer fasteners.

Figure 11:
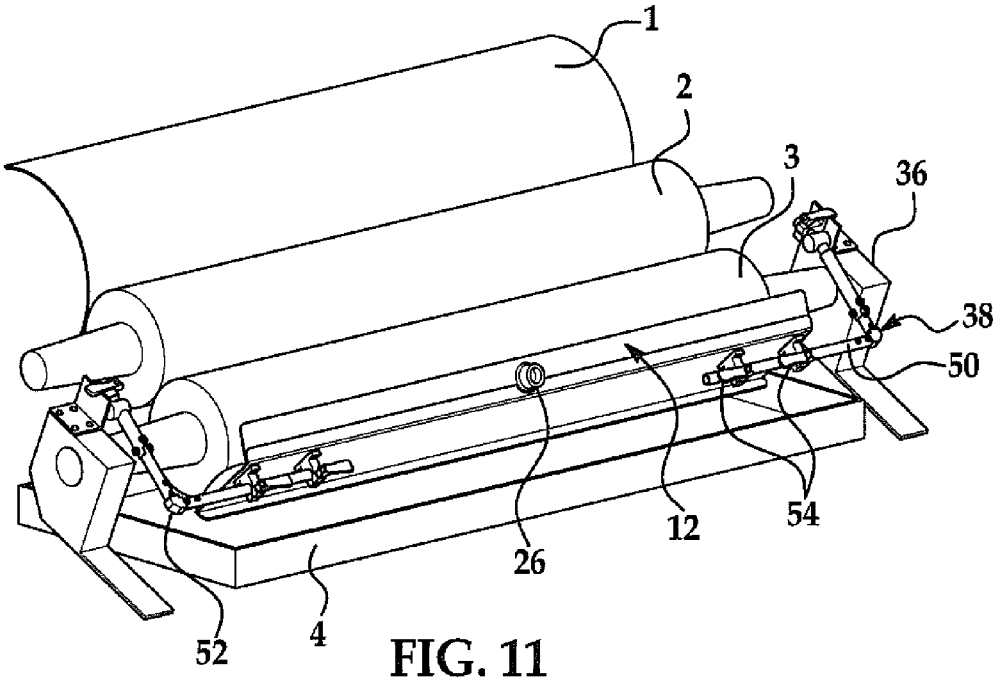
FIG. 11 is an orthogonal view of an embodiment of the mounting system in position.
Figure 12:
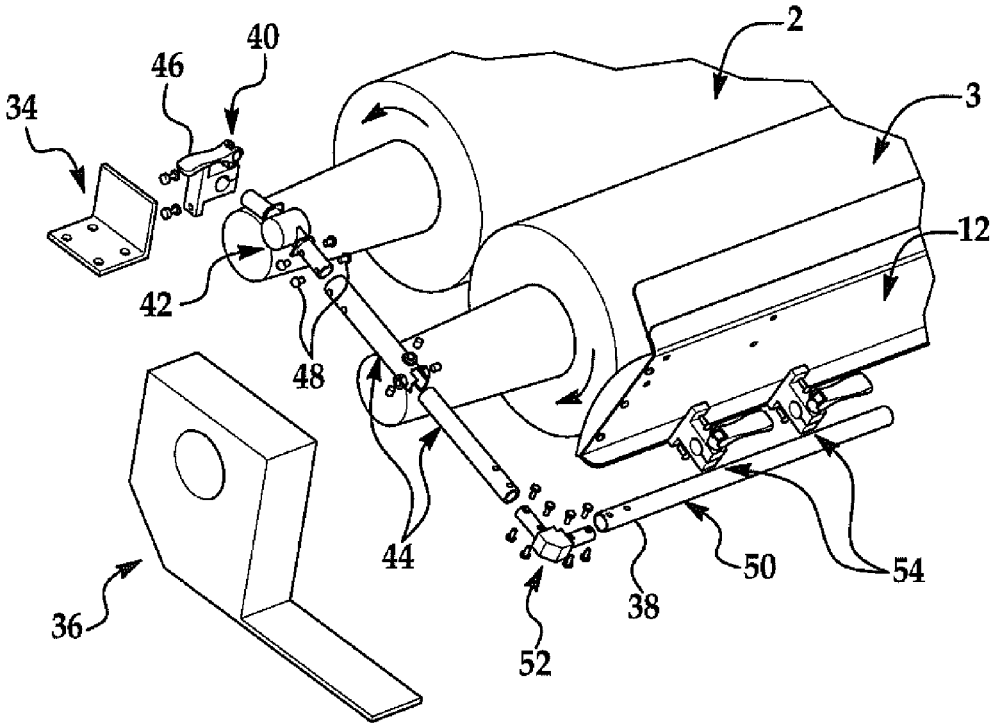
FIG. 12 is an exploded view of the mounting system of FIG. 11.

The mounting arm assembly suspends the profile control module assembly 12 from the mounting bracket 34 and provides adjustment in the X-, Y-, and Z-planes. This mounting system 38 is shown in an orthogonal view in FIG. 11. FIG. 12 depicts the detail of the mounting system 38 in an exploded view. Here we can see each of the components that work together to provide the uniform, yet infinitely adjustable gap between the pickup roll (3) and the profile control module assembly device 10. Though only the left end of the system is shown for clarity purposes, the right end is an exact mirror image of this configuration.

As previously described, the mounting bracket 34 is firmly attached to the pickup roll bearing saddle 36 and provides the reference location at each end of the pickup roll (3) from which all other positions are determined. Attached to the mounting bracket 34 is a pillow block 40 into which the mounting arm assembly 38 is inserted. The mounting arm assembly 38 is comprised of a hinge 42 which allows the angle of the extension arm assembly 44 to be accurately set. A shoulder on the shaft of the hinge 42 provides a positive stop to accurately and repeatedly place the mounting arm assembly 38 into the same location relative to the face of the pillow block 40. A locking handle 46 on the pillow block 40 compresses it onto the shaft of the Hinge 42, locking it into place. This combination serves as a releasable anchor point which allows the profile control module assembly 10 to be quickly removed as required for cleaning and service purposes and then, just as quickly, reinstalled into the same position.

Attached to the opposite end of the hinge 42 is the extension arm assembly 44. In the embodiment depicted, a plurality of screws 48 lock the female half of the extension arm assembly 44 to the hinge 40. In the embodiment depicted, four screws 48 essentially acting as pins to assure that there can be no twist in the associated assembly that would change the location of the profile control module assembly 10 relative to the face of the pickup roll (3). The male half of the extension arm assembly 44 is joined to the front profile control module mounting arm 50 with a suitable device such as the right angle bracket 52 utilizing a suitable screw configuration. In the embodiment depicted, the device employs the same screw configuration used to mount the female half to the hinge 42 to provide the same positively locked relationship.

The male half of the extension arm assembly 44 is inserted into the female half of the extension arm assembly 44. The extension arm assembly may include suitable means for adjusting the assembly length. In the embodiment depicted, the four set-screws in the female half of the assembly 44 allow the male half to be adjusted to obtain the exact length desired and then rigidly locked into position.

In the embodiment depicted in the various drawing figures, profile control module mounting arm 50 is inserted through the two pillow blocks 54 which are rigidly attached with screws to the gusset 24 to provide suitable mounting for the profile control module assembly 10. Where desired or required, the size and number of pillow blocks 54 will be that suitable to address issues of torsional load. In the embodiment depicted, the use of two pillow blocks (16) in the embodiment depicted reduces the torsional load on the extension arm assembly 44. The locking handles on the pillow blocks 54, when released, allow easy positioning of the profile control assembly 10 relative to the face of the pickup roll (3) and when locked, compress the pillow blocks 54 onto the profile control mounting arm 50 and together double the holding force to assure that the profile control module assembly 10 does not rotate along that mounting axis. This positioning mechanism provides a stable, yet adjustable system that allows the gap to be quickly modified to accommodate a wide range of viscous coatings all on the same coating head.

It is important to note that, in this configuration, the pan (4) has been lowered in a manner such that the coating material is no longer in contact with the pickup roll (3) and the pan (4) functions only as a catch basin for any unused coating material that is flushed out the ends of the profile control module assembly 10, or squeezed out from the nip (5). Because of this newly function, the dimensions of pan (4) can be reduced in length and width to cover only that area where the coating falls from the profile control module assembly 10 and the nip (5). If desired or required, the depth can be reduced to hold only the volume of coating material between the point where it falls and the outlet. This results in a reduction in pan volume of as much as 90% and therefore also significantly reduces the fill volume of the coating application system which represents a significant cost reduction in the coating process.

The invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for delivering fluid coating material to a substrate coating applicator having a pickup roller and an applicator roller in operative contact relationship with the pickup roller, the device comprising:

a unitary form having a fluid coating material introduction outlet, the fluid coating material introduction outlet configured to deliver fluid coating material to a position on the pickup roller, the form having a convex member in proximate fluid contact with the fluid coating material outlet, the convex member having opposed side edges and an elongated fluid coating material transit surface located between the side edges, the elongated fluid coating material transit surface having an initial fluid coating material delivery surface region located proximate to the fluid coating material introduction outlet and a terminal fluid coating material delivery surface region located distal to the fluid coating material fluid introduction outlet;

means for maintaining a metering gap between the pickup roller and the unitary form; and a fluid coating material collection pan, the fluid coating material collection pan located a spaced distance below and apart from the pickup roller and the convex member when the device is oriented in the use position, wherein the convex member is oriented at an angled spaced relationship relative to the fluid coating material collection pan such that the terminal coating delivery surface is located proximate to the coating material collection pan;

wherein the fluid coating material is delivered as a continuous stream over the elongated fluid coating material transit surface from the initial fluid coating material delivery surface region of the convex member to the metering gap, wherein the metering gap defines a metering nip; and wherein the fluid coating material travels over the convex member from the initial fluid coating material delivery surface to the metering gap as a continuous coating fluid material stream and excess fluid coating material is conveyed to fluid exits defined on the opposed side edges of the convex member, wherein the continuous coating fluid material stream flushes the metering gap with fresh fluid coating material.

2. The device of claim 1 wherein the metering gap maintaining means comprises at least one adjustable bracket connected with either the pickup roller or the applicator roller and connected to the unitary form.

3. The device of claim 1 wherein the fluid coating material introduction outlet is configured to flush the metering gap with fluid coating material in a manner that reduces edge-to-edge variation in physical properties of the fluid coating material.

4. The device of claim 1 wherein the metering gap maintaining means includes at least one adjustable bracket assembly connected with the pickup roller or metering roller, the bracket assembly including a mounting arm assembly, pillow blocks associated with a connection point between the unitary form and mounting arm assembly and hinge mechanisms connected to a stationary bracket and the mounting arm assembly.

5. The device of claim 4 wherein the coating material travels over the convex member from the initial coating material delivery surface to the metering gap as a continuous fluid stream.

6. The device of claim 1 further comprising:

an applicator nip located at the position of operative contact between the between the pickup roller and the applicator roller such that a measured portion of the coating material present on the pickup roller is passed through the applicator nip and transferred on to the applicator roller as a thin film; and wherein the metering nip is located at a position distant from the applicator nip.

7. The device of claim 6 wherein the pickup roller has a pickup roller surface and the applicator roller has an applicator roller surface, wherein the applicator roller surface is in contact with the pickup roller and is in operative contact with and delivers fluid coating material directly to a coatable surface.

8. The device of claim 1 wherein the unitary form has reverse face opposed to the convex member, the form comprising at least one bracket attached to and projecting from the reverse face, the bracket having a through bore configured to receive a cylindrical rod member, the cylindrical rod member connected to the mounting bracket.

9. The device of claim 8 wherein the form further comprises a reinforcement member.

10. The device of claim 8, wherein the form further comprises a flat elongate gusset, the flat elongate gusset connected to the opposed surface of the form and extending from the region proximate to the initial fluid coating transit surface to the region proximate to the fluid coating material outlet.

11. The device of claim 1 wherein the fluid coating material is a temperature controlled fluid coating material.

* * * * *